US009028169B2

(12) United States Patent
DeLoach et al.

(10) Patent No.: US 9,028,169 B2
(45) Date of Patent: May 12, 2015

(54) DOWNSPOUT DISSIPATOR

(71) Applicants: Eddie W. DeLoach, Savannah, GA (US); James M. DeLoach, Jr., Garden City, GA (US); Joseph Aaron, Overland Park, KS (US)

(72) Inventors: Eddie W. DeLoach, Savannah, GA (US); James M. DeLoach, Jr., Garden City, GA (US); Joseph Aaron, Overland Park, KS (US)

( * ) Notice: Subject to any disclaimer, the term of this patent is extended or adjusted under 35 U.S.C. 154(b) by 74 days.

(21) Appl. No.: 13/915,337

(22) Filed: Jun. 11, 2013

(65) Prior Publication Data

US 2013/0330127 A1 Dec. 12, 2013

Related U.S. Application Data

(60) Provisional application No. 61/658,541, filed on Jun. 12, 2012.

(51) Int. Cl.
*E04D 13/08* (2006.01)

(52) U.S. Cl.
CPC ..... *E04D 13/08* (2013.01); *E04D 2013/0806* (2013.01); *E04D 2013/0813* (2013.01)

(58) Field of Classification Search
USPC ..... 405/80; 52/12, 16
See application file for complete search history.

(56) References Cited

U.S. PATENT DOCUMENTS

| | | | | |
|---|---|---|---|---|
| 5,227,078 | A | 7/1993 | Augustine, III | |
| 5,358,007 | A | 10/1994 | Carlberg | |
| 6,240,680 | B1 | 6/2001 | Estes | |
| 7,736,090 | B2 | 6/2010 | Janesky | |
| 2008/0295418 | A1 * | 12/2008 | Edell | 52/16 |
| 2011/0173897 | A1 * | 7/2011 | Schneider | 52/16 |

* cited by examiner

*Primary Examiner* — Benjamin Fiorello
*Assistant Examiner* — Kyle Armstrong
(74) *Attorney, Agent, or Firm* — Gardner Groff Greenwald & Villanueva, PC

(57) ABSTRACT

A dissipator for providing controlled water drainage from a downspout. The dissipator comprises a base and a cover plate. The base provides engagement with a downspout and the cover plate is configured to mount to a portion of the base, defining at least one drainage hole. A skirt portion of the base couples to the downspout so that the at least one drainage hole of the cover plate provides controlled water drainage by dissipating the water flowing within the downspout and through the dissipator.

13 Claims, 6 Drawing Sheets

DOWNSPOUT DISSIPATOR

CROSS-REFERENCE TO RELATED APPLICATION

This application claims the benefit of U.S. Provisional Patent Application Ser. No. 61/658,541, filed Jun. 12, 2012, the entirety of which is hereby incorporated herein by reference for all purposes.

TECHNICAL FIELD

The present invention relates generally to fluid flow control and erosion control, and more particularly to an apparatus for use with rain gutter and downspout systems to dissipate rainwater or other liquids flowing therethrough efficiently and in a manner that reduces or eliminates erosion around the downspout discharge area.

BACKGROUND

Buildings, such as homes, apartments or other structures provided with a roof may have gutters to transport and redirect precipitation, HVAC condensate, and/or other fluids through a downspout where the water is released adjacent the building. The released water has been known to be destructive to the area near the foundation and/or the landscape nearby, particularly erosive or disruptive to common items used to dress the landscape, for example ground covers (pinestraw, mulch, etc.), flower beds, sod and/or plants.

In an attempt to reduce erosion, downspouts have been known to include various forms of extensions (above or below the ground) to direct and release the water away from the building, which typically require considerable additional costs, effort and time to install, especially when regular maintenance of the landscape is required. Other known downspouts are commonly provided with a splash block or other non-erosive surface, generally directly below the outlet to both reduce the rate of flow and change the direction (dispersal) of the flowing water before moving into the ground close to the foundation of the building, which can be both unsightly and inefficient, and can potentially cause the same erosion typical of downspouts lacking any attempt to reduce erosion (extension, splash block, etc.).

There is an ongoing need for improvements to drainage systems having downspouts or drainage pipes to eliminate the occurrence of erosion of areas near the output of the drainage pipe and the ground surface nearby, and to reduce the associated cost, assembly and size of devices eliminating the same. It is to the provision of improved downspout accessories and dissipators meeting these and other needs that the present invention is primarily directed.

SUMMARY

In example embodiments, the present invention provides a dissipating downspout or dissipator plate attachment for a downspout for controlling the flow rate and fluid dispersion of water discharged through a downspout or drainage pipe.

In one aspect, the present invention relates to a dissipative downspout for draining water from a building to a ground surface. The dissipative downspout includes an elongate pipe and a flow control member. The elongate pipe includes an inlet section and an outlet section. The flow control member includes a drainage surface having a plurality of drainage holes configured to dissipate the drain water flowing therethrough. The flow control member is configured to mount at or proximal to the outlet section.

In another aspect, the invention relates to a dissipator for providing optimal water drainage from a downspout. The dissipator includes a base and a cover. The base forms a skirt portion and a lip portion. The skirt portion extends from a first end to a second end and defines a peripheral surface and an inner surface, and the lip extends generally transverse the skirt at the second end. The cover is configured to mount to the lip portion and defines a plurality of drainage holes. The skirt portion couples to the downspout so that the plurality of drainage holes of the drainage surface provide optimal water drainage by dissipating the water flowing within the downspout and through the dissipator.

Optionally, the cover includes at least one or more flanges to provide for slidingly engaging the cover with the lip portion of the base. In one form, the at least one or more flanges extend inwardly from an outer contour of the cover towards the drainage surface.

In yet another aspect, the present invention relates to a dissipator for dissipating drainage from a downspout. The dissipator includes a base and a cover. The base is configured to engage and the cover includes an array of holes having nine rows and five columns of 3/16" holes. The array of holes provide optimal drainage by dissipating the drainage flowing within the downspout and through the dissipator. In one example form, the cover is integral with the base. In another example form, the cover is removably mountable with the base. Preferably, the dissipator is configured to removably mount to an outlet of the downspout. In one example form, the outlet of the downspout includes an elbow or attachment mounted thereto.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
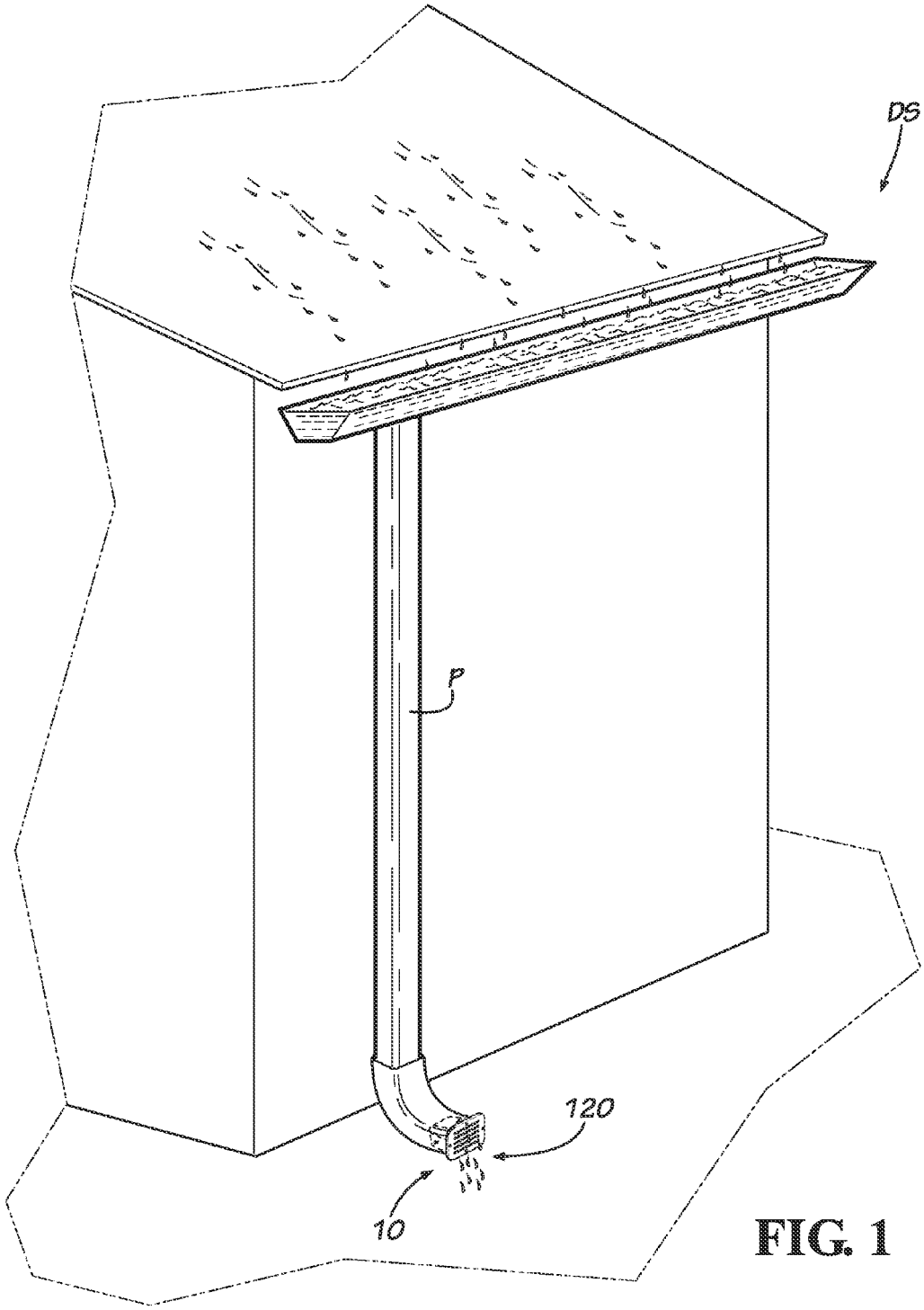
FIG. 1 shows a rain gutter drainage system comprising a drainage pipe or downspout having a dissipator according to an example embodiment of the present invention.

In example embodiments, the present invention relates to a dissipative downspout or dissipator attachment for providing optimal drainage from a downspout or drainage pipe, thereby providing a desired rate of flow and dispersion of water flowing through the downspout and discharged onto the ground or other surface. With reference now to the drawing figures, wherein like reference numbers represent corresponding parts throughout the several views, FIG. 1 shows a drainage system DS comprising a flow control member or dissipator 10 according to an example embodiment of the present invention. As shown, a downspout or drainage pipe P mounts along a side of a building or other structure and extends generally vertically from an inlet to an outlet. The inlet of the drainage pipe P communicatively engages a rain gutter or catch reservoir below the roof of the building and extends to the outlet near the ground surface adjacent the base of the building. The outlet comprises an elbow portion that is substantially arcuate in shape and redirects the drainage to be dissipated in a direction or discharge direction substantially transverse to the direction of drainage flowing within the drainage pipe P and parallel to the ground. As water begins to accumulate on the roof, the water proceeds to flow into the gutter (by the inclination or pitch of the roof) where it is redirected to flow into the inlet of the drainage pipe P. The dissipator 10 mounts to the outlet of the drainage pipe P and provides a plurality of drainage holes for dissipating the water and controlling its flow as it is released onto the ground. As such, the dissipator 10 reduces or eliminates erosion occurring on the ground surface or landscape nearby. In alternate embodiments, the elbow portion or other desired extension or attachment can be formed in a plurality of sizes, shapes, and/or forms as desired, and the discharge direction of the elbow portion and/or path can vary as desired. Optionally, the dissipater can be removably attached, permanently attached, or integrally formed with the elbow and/or the downspout.

Figure 2:
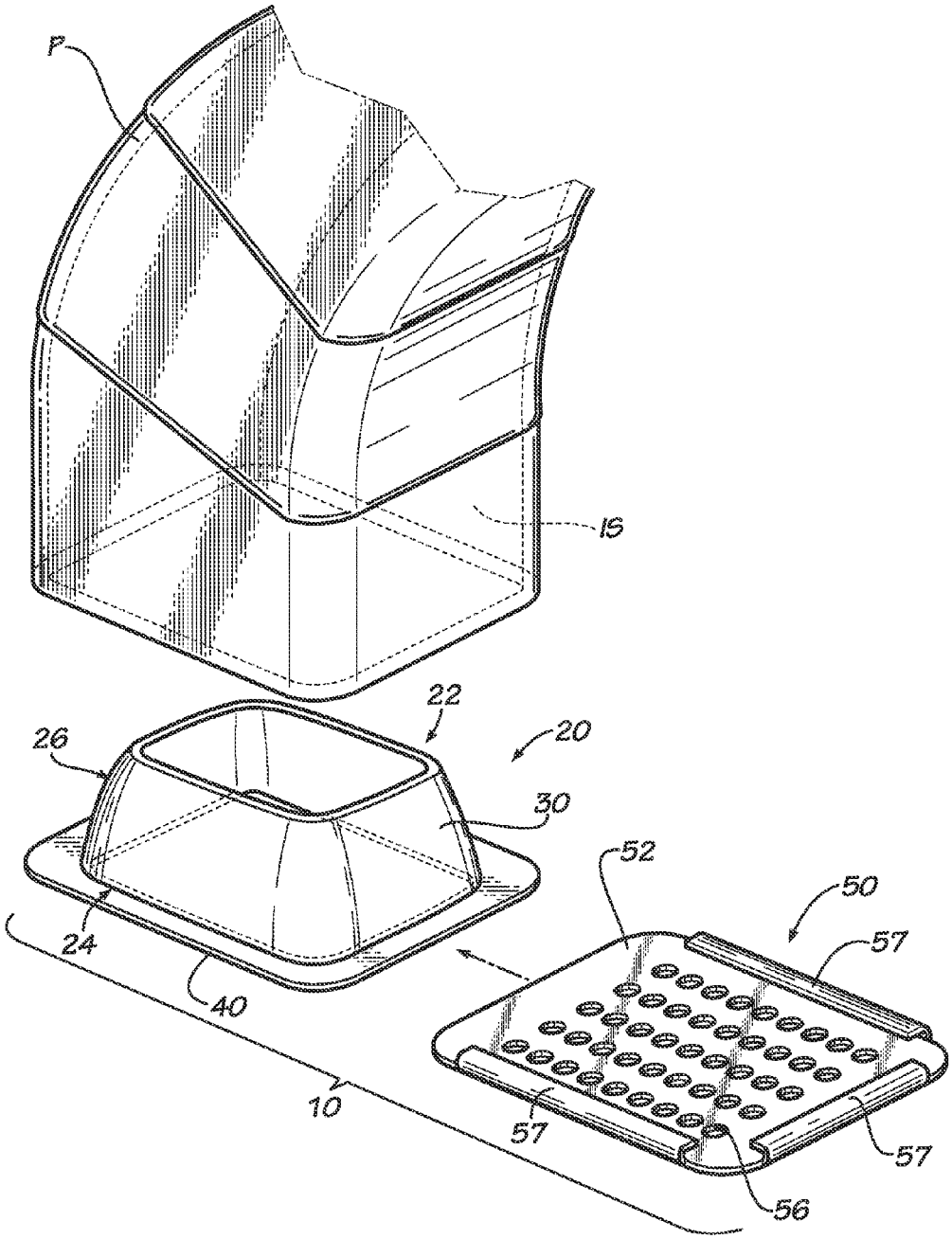
FIG. 2 is an assembly view of the drainage pipe dissipator shown in FIG. 1, showing a portion of a drainage pipe to which the dissipater is mountable.

FIG. 2 is an assembly view showing an example mode of mounting of the dissipator 10 to a downspout. As depicted, the dissipator 10 comprises a base 20 and a cover plate 50. In example embodiments, the base 20 generally forms a bottomless pan-like flange or skirt 26 and extends from a first end 22 to a second end 24 wherein a mounting lip or surface 40 projects transversely therefrom. The skirt 26 is preferably sized, shaped and/or formed as desired and comprises a peripheral or outer surface 30 for providing frictional engagement with an inner surface IS of the drainage pipe P such that the second end of the peripheral surface of the skirt is contiguous with the inner surface of the downspout and the first end is not, and an inner surface 32 generally opposite the outer surface 30 (see FIGS. 1,4). The mounting surface 40 provides a contact and engagement surface for mounting the cover 50 thereto. Alternatively, various other forms of coupling features and/or hardware or fasteners can be used as desired to provide engagement between the base 20 and the cover plate 50 (as will be described below). In one form, the skirt 26 and mounting surface 40 of the base 20 are integrally formed and provide a continuous L-shaped profile extending along a generally rectangular path. In alternate forms, the profile and path can vary to accommodate frictional engagement with the various sizes, shapes and forms of drainage pipes. Optionally, the skirt 26 and the mounting surface 40 may be separable and provide for removably mounting the same together.

Figure 3A:
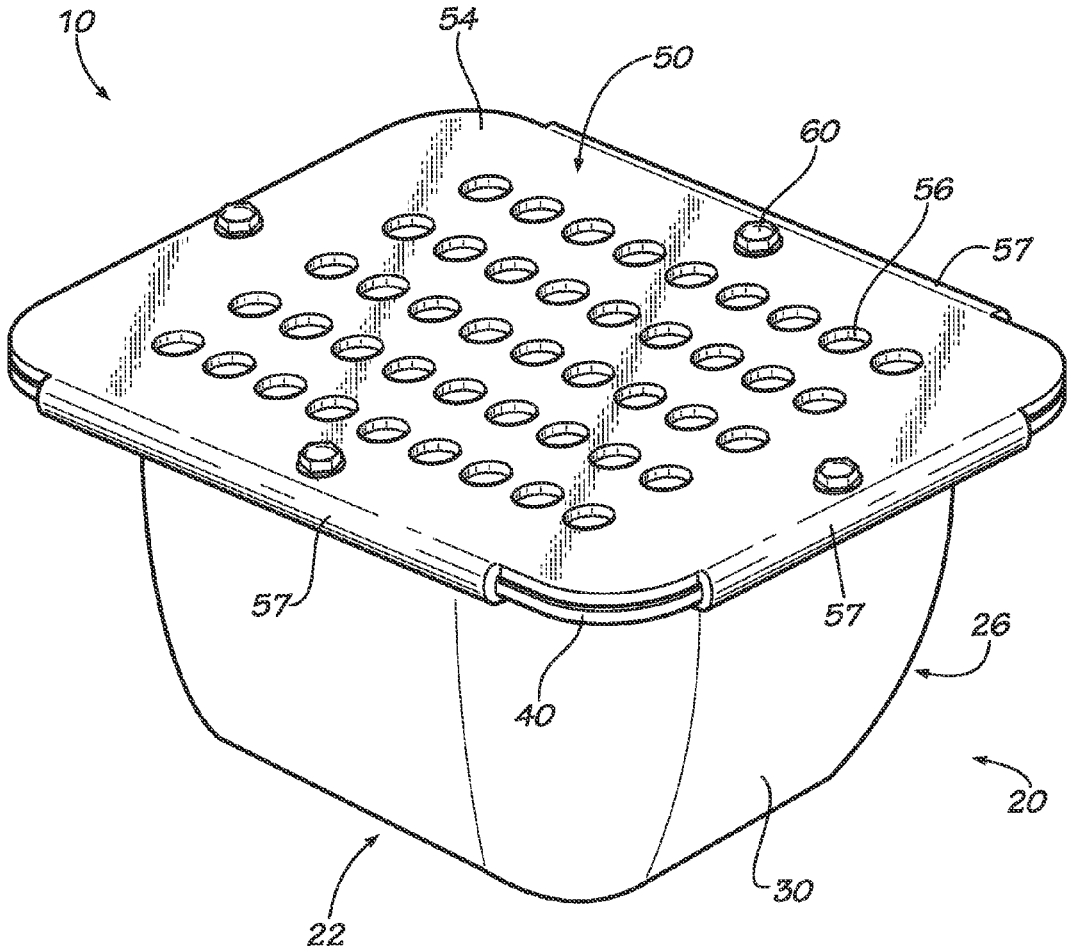
FIG. 3A shows a top perspective view of an assembled drainage pipe dissipator according to an example form of the invention.
Figure 3B:
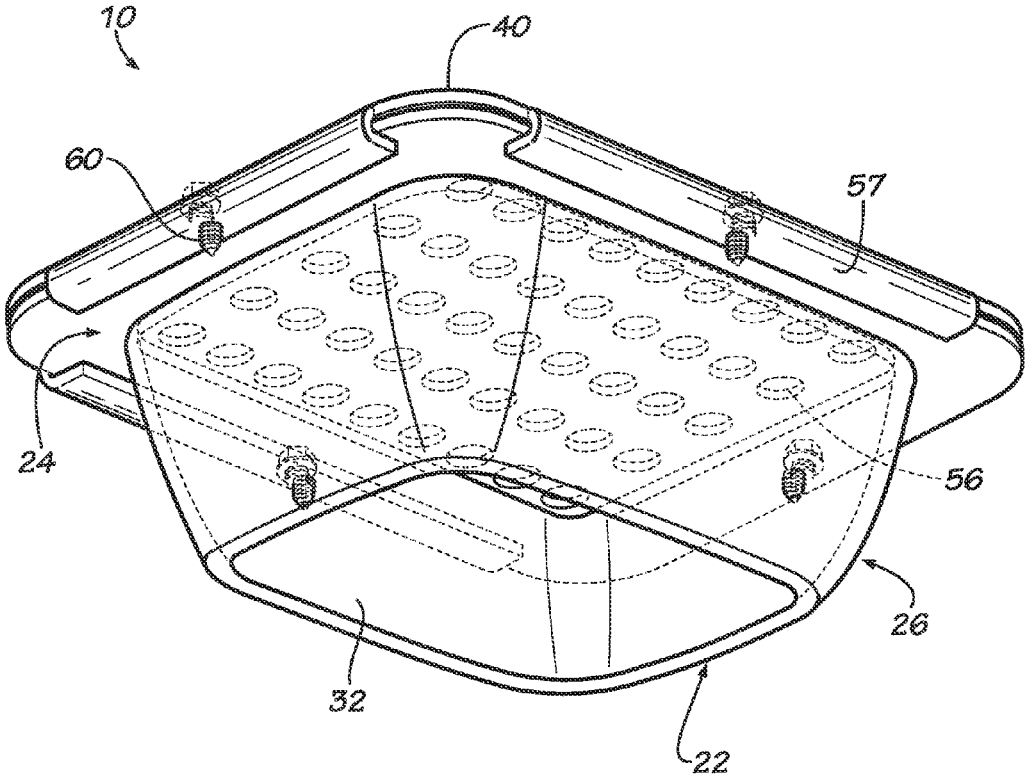
FIG. 3B shows a bottom perspective view of the drainage pipe dissipator of FIG. 3A, showing hidden portions thereof in broken lines.

The cover plate 50 is generally planar and formed to substantially align with the outer contour of the mounting surface 40 of the base. In example embodiments, the cover 50 is formed from a plate having an inner surface or drainage surface 52 and an outer surface 54, wherein a plurality of drainage holes 56 provided therebetween allow for the dissipation of water 120 flowing therethrough (shown in FIG. 1). In one form, the cover 50 comprises a mounting area and a dissipation area. The mounting area is defined by the portion of the cover 50 in contact with the mounting surface 40 of the base 20, and the dissipation area is defined by the portion of the cover 50 covering the opening defined by the inner contour of the mounting surface 40. Preferably, at least one or more inwardly hooked flanges 57 extend inwardly from the outer contour of the mounting area towards the dissipation area such that the plate 50 can slidingly engage the mounting surface 40 of the base 20. For example, to engage the plate with the base, the plate is positioned to slide across the mounting surface 40 (see direction arrow) such that the mounting surface 40 is engaged and held between the inner surface 52 and the flanges 57. After the flanges 57 are engaged with the mounting surface, screws 60 or fasteners are optionally installed to securely mount the two together (see FIGS. 3A-B). Alternatively the screws can be omitted to allow the cover plate to slide off of the base for cleanout of the downspout, and slid back in place for use, without the need for removing and reinstalling screws. In one form, the flanges 57 are integral with the plate 50 wherein they are bent to extend inwardly towards the dissipation area. Optionally, the flanges 57 can be removably mounted to the plate 50.

To mount the dissipator 10 to the drainage pipe P, the skirt 26 projecting towards the first end 22 is preferably frictionally engaged with the inner surface IS of the drainage pipe P. The drainage pipe P is generally rectangular and comprises the inner surface IS having a substantially similar contour to the outer surface 30 of the base 20. Preferably, the engagement between the dissipator 10 and the drainage pipe P allows for both optimal dissipation when mounted thereto (see FIG. 1) and removing therefrom as desired, for example, when the drainage pipe is to be cleaned or contains debris therein. Optionally, additional mounting features can provide for pivotally or translationally mounting the dissipator and/or the cover to the drainage pipe. Common downspouts or drainage pipes include cross-sectional shapes such as rectangular (2"×3", 3"×4" and 4"×5"), plain round or circular (3", 4", 5" and 6"), round corrugated (3", 4", 5" and 6") and spiral (4") in various materials, for example, aluminum, copper, steel and galvalume, and others. In alternate embodiments, the dissipator 10 can removably mount to the drainage pipe in various other forms, for example, inter-engagement features, snap fittings, screws, bolts, adhesives, and/or mounting means.

The capacity of the dissipator 10 can vary depending upon several factors in addition to the various sizes, shapes, and/or configurations of the drainage holes 56. Generally, the factors are known to include the roof area of the building, the slope of the roof, the anticipated maximum rainfall intensity and the dissipation surface area of the cover 50. In example embodiments, recorded data indicating rainfall for a particular location may be used with other calculations to determine the capacity of the dissipator 10. For example, it has been known to use a rainfall intensity map showing the maximum hourly rainfall intensity (inches per hour for a five minute interval) to be expected once in ten years. Preferably, the rainfall intensity records provide approximate rainfall rates to determine the required quantity of downspouts having dissipators 10 and/or the dissipation surface area of the cover 50 necessary to remain below or at full capacity for a given roof area ($ft^2$). For example, a dissipator 10 having a cover providing a dissipation surface area of about (4"×2.5", 10 $in^2$) will fluctuate in capacity depending upon the rainfall intensity (2 inches per hour-11 inches per hour, lasting 5 minutes) such that the area of the roof allocated to the dissipator 10 is inversely proportional to the rainfall intensity. For example, as the rainfall intensity increases, the calculated area of the roof allocated for redirecting the rainfall within the drainage pipe (further dissipating) while remaining at or below the capacity of the dissipator decreases. In one example, for a rainfall intensity of about 2 inches per hour, the capacity of the dissipator 10 (having a dissipation surface of about 4"×2.5") corresponds with a roof area of about 1680 square feet. In another example, for a rainfall intensity of about 11 inches per hour, the capacity of the dissipator 10 (having a dissipation surface of about 4"×2.5") corresponds with a roof area of about 310 square feet. Thus, depending upon the rainfall intensity and the total area of the roof, the quantity of dissipators and/or the dissipation surface area can vary to ensure that the capacity is not exceeded.

Figure 4:
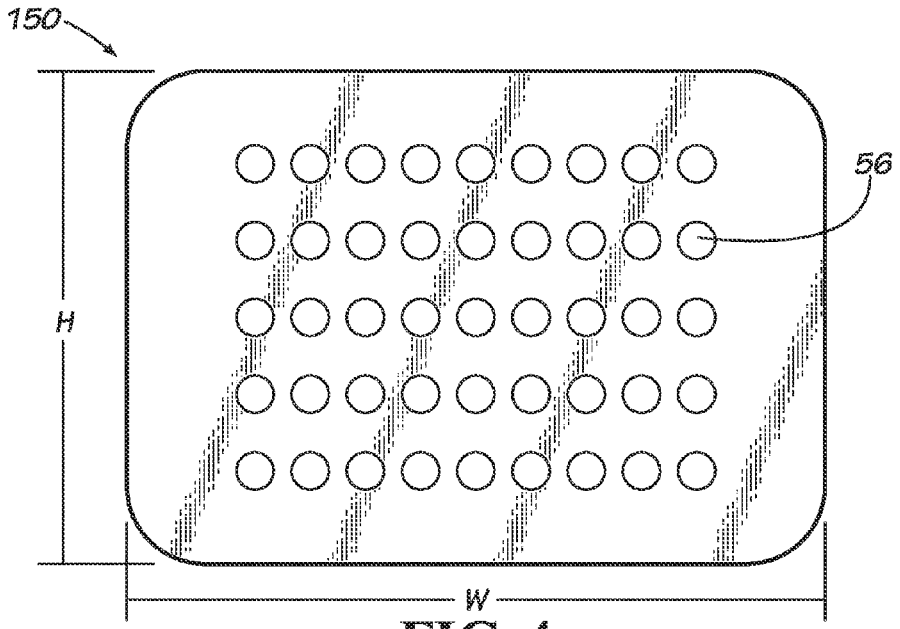
FIG. 4 shows a dissipator plate for installation at a lower end of a downspout according to an example embodiment of the invention.

Preferably, the drainage holes 56 are configured in opening size, shape, arrangement and/or spacing to provide a specified dispersion of the dissipated water. As shown in FIG. 4 according to another example embodiment of the present invention, a cover 150 comprises an array of the drainage holes 56. In example forms, the hole size is between about 1/16" to about 3/4", more preferably between about 1/8" to about 1/4", for example about 3/16". The array of drainage holes 56 is preferably configured with about 1-10 rows of holes spaced along the height H of the cover 50 and about 1-15 columns of holes spaced along the width W of the cover 50 to form an array of about 2-150 openings, preferably about 30-60 openings, for example 45 openings. In example embodiments, the cover 150 is generally rectangular-shaped and includes a 9×5 array of 3/16" holes and provides about five square inches (5 $in^2$) of openings to allow for dissipation. In example embodiments, the ratio of the openings (≈5 $in^2$) to the dissipation surface area (2"×3"=6 $in^2$) is generally within a range of about 1:2 or 50% to about 90%.

The spacing between the drainage holes 56 can vary as desired to provide a specified dissipation performance. In example embodiments, the columns of openings are spaced to define a center-to-center dimension of about 3/8" (or about 3/16" from edge of one hole to adjacent edge of next hole), and the rows are spaced to define a center-to-center dimension of about 1/2" (or about 5/16" from edge of one hole to adjacent edge of next hole). Alternatively, the plurality of drainage openings can be configured with alternative sizes, shapes, spacing, and/or patterns to accommodate a desired dissipation capacity. The drainage openings of the cover 50, 150 can be punched, drilled, molded (e.g., when the cover is plastic) or otherwise formed. Optionally, the cover plate may form non-planar geometries wherein the dissipation area and/or mounting area exhibit alternate shapes and/or forms, for example, spherical, cylindrical, box-like, arcuate, and/or others as desired, for example to increase the available surface area in which dissipation openings can be provided, wherein the areas may project uniformly and/or non-uniformly beyond the mounting surface 40 of the base 20, and may also project internally and/or externally the drainage pipe when mounted thereto.

Figure 5:
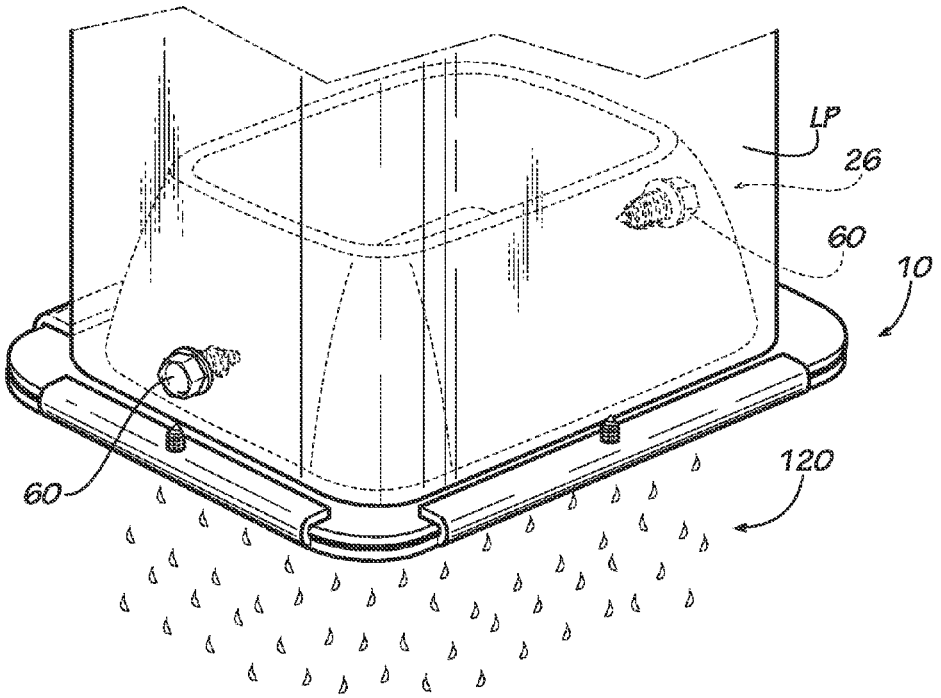
FIG. 5 shows the dissipator removably mounted to a drainage pipe according to another example embodiment of the present invention, wherein the drainage pipe is substantially linear.

FIG. 5 shows the dissipator 10 mounted to the bottom end of a substantially linear drainage pipe LP according to another example manner of installation of the dissipater according to the present invention. As depicted, the linear drainage pipe LP is generally elongate wherein the dissipator 10 mounts to the outlet. Thus, when a linear drainage pipe LP is provided for use with the dissipator 10, the discharge direction of the drainage to be dissipated is substantially similar to the direction of the drainage flowing within the linear drainage pipe LP (see water 120). Optionally, one or more screws 60 are installed to mount the dissipator 10 to the outlet of the drainage pipe, for example, wherein the screw 60 extends through a sidewall portion of the drainage pipe and into the skirt 26 of the dissipater base.

Figure 6:
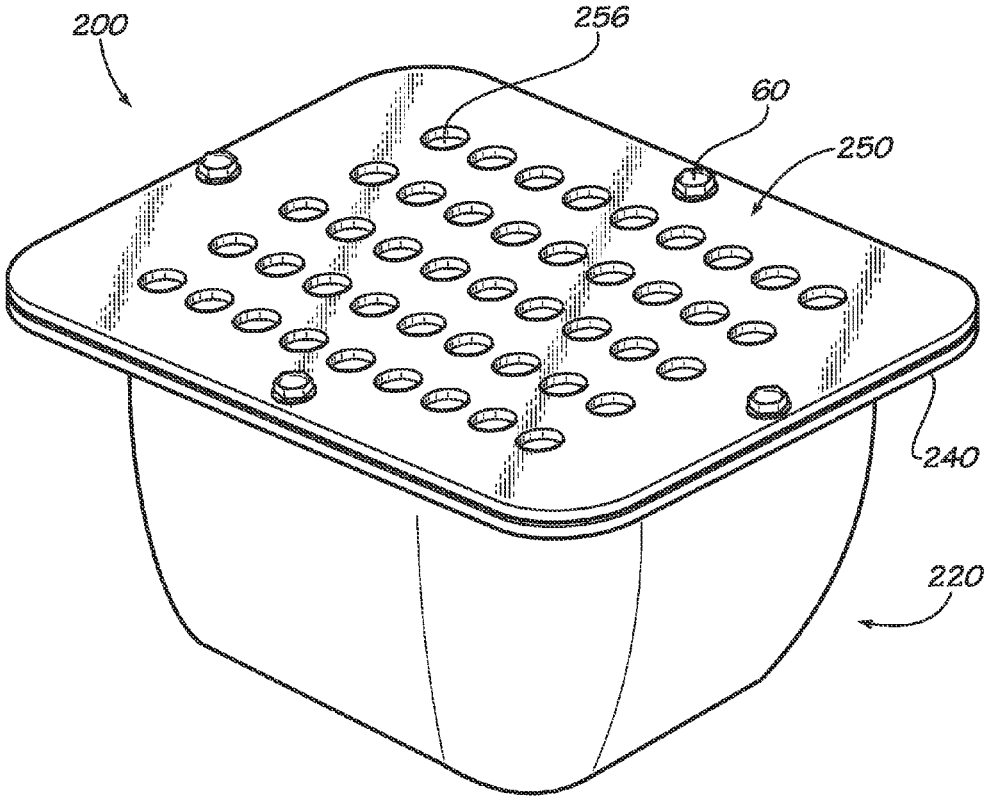
FIG. 6 shows a top perspective view of a drainage pipe dissipator according to another example embodiment of the present invention.

FIG. 6 shows a dissipator 200 according to another example embodiment of the present invention. Generally, the dissipator 200 is substantially similar to the dissipator 10, for example wherein each comprises the base 20, 220 and the dissipator plate 50, 250. Preferably, as depicted, the plate is substantially planar and formed to substantially align with the outer contour of the mounting surface 240 wherein screws 60 are provided to mount the two together.

In example embodiments, the dissipator 10 can be formed from a plurality of materials including metal, composites, plastics, ceramics, other desired materials or combinations thereof. In one form, the dissipator 10 is constructed of galvanized steel or aluminum and has a thickness of about 26 gauge. The cover defines an area of about 15.5 $in^2$ (4.75"×3.25"), wherein an area of about 5.5 $in^2$ is provided for the mounting area and an area of about 10 $in^2$ (4"×2.5") is provided for the dissipation area. Alternatively, the cover can be provided in other desired thicknesses and/or define a desired dissipation area.

While the invention has been described with reference to preferred and example embodiments, it will be understood by those skilled in the art that a variety of modifications, additions and deletions are within the scope of the invention, as defined by the following claims.

What is claimed is:

1. A dissipator device for controlling discharge from a downspout, the dissipator comprising:

a base, the base forming a skirt portion and a lip portion, the skirt portion extending from a first end to a second end and defining a peripheral surface and an inner surface, and the lip extending generally transverse the skirt at the second end; and a cover plate, defining a drainage surface and configured to mount to the lip portion of the base, the drainage surface having a plurality of drainage holes formed therein, wherein the skirt portion is configured to be received internally within the downspout to engage the peripheral surface of the skirt in the downspout such that the second end of the peripheral surface of the skirt is contiguous with the peripheral surface of the downspout and the first end is not so that rainwater discharges from the downspout through the plurality of drainage holes of the drainage surface to provide controlled dissipation of rainwater from the downspout.

2. The dissipator of claim 1, wherein the cover plate defines a 9×5 array of circular 3/16" diameter drainage holes spaced across a 2"×3" diffuser face.

3. The dissipator of claim 1, wherein the ratio of the drainage holes to the drainage surface is within a range of about 50% to about 90%.

4. The dissipator of claim 1, wherein the cover plate comprises at least one flange to provide for slidingly engaging the cover plate with the lip portion of the base in a side-to-side motion.

5. The dissipator of claim 4, wherein the at least one flange extends inwardly from an outer contour of the cover plate towards the drainage surface.

6. A dissipator for dissipating drainage from a downspout, the dissipator comprising:

a base, the base configured for engaging a downspout and comprising a skirt portion and a lip portion, wherein the skirt portion extends generally transverse the lip portion, and wherein the skirt portion is configured for removably engaging an internal portion of the downspout such that a second end of a peripheral surface of the skirt portion is contiguous with the internal portion of the downspout and a first end is not;

a cover plate comprising an array of holes comprising about five rows and about nine columns of approximately 3/16" diameter holes, wherein the cover plate is removably mountable to the base and comprises an opposed pair of inwardly hooked flanges configured to receive and release the lip portion of the base as the cover plate is slidingly engaged transversely onto the base; and wherein the array of holes of the cover plate provide controlled drainage by dissipating water discharged from the downspout.

7. The dissipator of claim 6, wherein the rows and columns of holes are spaced across a 2"×3" diffuser face.

8. The dissipator of claim 6, wherein the opposed pair of inwardly hooked flanges extend inwardly from an outer contour of the cover plate towards a drainage surface having the array of holes.

9. The dissipator of claim 6, wherein the outlet of the downspout comprises an elbow attachment.

10. A dissipative downspout system for draining water from a building to a ground surface, the dissipative downspout system comprising an elongate downspout and a flow control member, the elongate downspout having an inlet section and an outlet section, the flow control member comprising a drainage surface having a plurality of circular drainage holes configured to dissipate water flowing therethrough, and the flow control member further comprising a base for attachment to the downspout, the base comprising a skirt configured for insertion into the elongate downspout, and wherein the skirt comprises a peripheral surface for engagement with an internal surface of the downspout such that a second end of the peripheral surface of the skirt is contiguous with the internal surface of the downspout and a first end is not.

11. The dissipative downspout system of claim 10, wherein the circular drainage holes define a total opening area of about five square inches distributed across a drainage surface area of about 2"×3".

12. The dissipative downspout system of claim 10, wherein the skirt portion is configured for removably engaging the internal surface of the downspout.

13. The dissipative downspout system of claim 12, wherein the flow control member comprises a removable cover plate having an opposed pair of inwardly hooked flanges configured to slidingly couple with the lip portion of the base.

* * * * *